US009903125B2

(12) United States Patent
Hoffman et al.

(10) Patent No.: US 9,903,125 B2
(45) Date of Patent: Feb. 27, 2018

(54) SYSTEM AND METHOD FOR INSTALLATION OF CROWN MOLDING ON IMPERFECT WALLS

(71) Applicants: Jeremy P. Hoffman, Newtown, PA (US); Robert MacMillan, Perkasie, PA (US)

(72) Inventors: Jeremy P. Hoffman, Newtown, PA (US); Robert MacMillan, Perkasie, PA (US)

( * ) Notice: Subject to any disclaimer, the term of this patent is extended or adjusted under 35 U.S.C. 154(b) by 0 days.

(21) Appl. No.: 15/011,474

(22) Filed: Jan. 29, 2016

(65) Prior Publication Data

US 2016/0222677 A1 Aug. 4, 2016

Related U.S. Application Data

(60) Provisional application No. 62/109,443, filed on Jan. 29, 2015, provisional application No. 62/128,273, (Continued)

(51) Int. Cl.
*E04F 19/04* (2006.01)

(52) U.S. Cl.
CPC ..... *E04F 19/0436* (2013.01); *E04F 19/0459* (2013.01); *E04F 19/0486* (2013.01); (Continued)

(58) Field of Classification Search
CPC ... E04F 19/0436; E04F 19/04; E04F 19/0427; E04F 19/0459; E04F 19/0486; (Continued)

(56) References Cited

U.S. PATENT DOCUMENTS 3,200,547 A * 8/1965 Johnson ..... E04F 19/028 206/586
3,207,274 A * 9/1965 Baermann ..... A45C 5/02 150/154

(Continued)

OTHER PUBLICATIONS

PCT/US2016/015846 Written Opinion of the International Searching Authority and International Search Report.

*Primary Examiner* — Babajide Demuren
(74) *Attorney, Agent, or Firm* — Clinton H. Wilkinson; Charles A. Wilkinson

(57) ABSTRACT

A molding system installed at or near the top of a vertical wall having a molding portion and an attachment portion, where the attachment portion is attached securely to the wall above at least the center of mass of the molding portion, and the molding portion has an outwardly visible decorative face which extends down to where the lower edge of the molding portion meets the wall. The attachment portion is enabled to flex as it is firmly attached to an imperfect wall, and the structure of the molding portion is such that the decorative face of the molding system remains preferentially straight and preferentially positioned as the molding system is installed on an irregular wall. A hinge-like flex is enabled along the length of the molding above the center of mass of the molding portion such that the decorative face of the molding can pivot like a pendulum ensuring the lower edge of the molding is placed against the wall. None of the methods of installation of this system violate the decorative face of the molding and a consistent decorative face profile extends around the entire installation.

19 Claims, 15 Drawing Sheets

Related U.S. Application Data filed on Mar. 4, 2015, provisional application No. 62/183,856, filed on Jun. 24, 2015.

(52) U.S. Cl.
CPC ..... *E04F 2019/0422* (2013.01); *E04F 2019/0427* (2013.01)

(58) Field of Classification Search
CPC ..... E04F 2019/0431; E04F 2019/0422; E04F 2019/0427
USPC ..... 52/288.1, 272–273
See application file for complete search history.

(56) References Cited

U.S. PATENT DOCUMENTS 4,052,830 A * 10/1977 Smith ..... E04F 19/04 52/288.1
4,204,376 A * 5/1980 Calvert ..... A47K 3/008 52/288.1
4,578,905 A * 4/1986 Hout ..... E06B 1/62 49/467
5,001,877 A * 3/1991 Edwards ..... B44C 5/00 403/295
5,428,929 A * 7/1995 Reese ..... E04F 19/028 52/255
5,457,923 A * 10/1995 Logan ..... E04F 19/0436 52/272
5,590,496 A * 1/1997 Martin ..... E06B 1/6015 206/321
5,694,726 A * 12/1997 Wu ..... E04F 19/0436 174/504
5,749,512 A * 5/1998 Gingras-Taylor ..... B65D 5/445 206/459.5
6,050,037 A * 4/2000 Gifford ..... E06B 1/62 52/211
6,837,020 B1 * 1/2005 Keddell ..... E04F 19/02 52/288.1
7,392,625 B2 * 7/2008 Bruggink ..... E06B 1/62 52/204.55
7,958,685 B2 * 6/2011 Rowohlt ..... E04F 19/0436 52/287.1
7,997,043 B1 8/2011 MacMillan et al.
8,375,660 B2 * 2/2013 Nolan ..... E06B 1/34 52/204.53
8,887,460 B1 11/2014 Hoffman et al.
2002/0059760 A1 * 5/2002 Heard ..... E06B 1/6015 52/211
2003/0093970 A1 5/2003 Jensen
2004/0040235 A1 * 3/2004 Kurtz ..... E04F 19/0468 52/288.1
2005/0155312 A1 7/2005 Friday
2005/0193664 A1 * 9/2005 Koenig, Jr. ..... E04F 19/0436 52/287.1
2006/0096203 A1 * 5/2006 Weinstein ..... E04F 19/0463 52/288.1
2009/0013636 A1 * 1/2009 Wilson ..... E04F 19/02 52/718.01
2010/0071288 A1 * 3/2010 Jun ..... E04F 19/0468 52/288.1
2011/0179733 A1 * 7/2011 Picken ..... E04F 19/02 52/242
2013/0278019 A1 * 10/2013 Preisler ..... B60R 5/04 296/193.07

* cited by examiner

SYSTEM AND METHOD FOR INSTALLATION OF CROWN MOLDING ON IMPERFECT WALLS

CROSS REFERENCE TO RELATED APPLICATIONS

This application claims priority to provisional application No. 62/109,443 filed on Jan. 29, 2015, provisional application No. 62/128,273 filed on Mar. 4, 2015, and also provisional application No. 62/183,956 filed on Jun. 24, 2015, the contents of which are incorporated herein by reference in their entireties.

FIELD OF THE INVENTION

The present invention is directed to systems and methods for installing crown molding in a building, and more particularly to a molding assembly and method of installation that speeds the process and is particularly suited to spaces where walls, and junctions of walls, are imperfect and vary from the true geometric planes that were intended. The present invention is also suited to various applications where the molding may bear weight in addition to its own, such as supporting a suspended ceiling or supporting various electrical equipment.

BACKGROUND OF THE INVENTION

Crown molding is a desirable design element that improves the appearance of interior spaces. Wood crown molding has been used in buildings for many years, and is traditionally installed where there is a fixed ceiling, and at the top of the wall, with the crown molding fastened to both the ceiling and the wall. The crown molding is securely attached to the wall by nailing with nails being passed through the decorative face of the molding into the wall, and, separately, into the ceiling. This installation method, however, leaves holes and marks where the nails travel through the decorative face, requiring patching to regain a smooth surface on the decorative face. Further, installing traditional crown molding where walls meet in the corners of a room is a known carpentry challenge, with precision cuts at difficult to determine angles required. The difficulty of satisfactorily installing traditional crown molding in corners is one of the reasons that installing traditional crown molding is considered one of the most difficult trim work installations.

Traditional wood crown molding is also largely stiff, and has little ability to flex over small longitudinal distances, such as less than one foot, and for small distances will remain very close to straight. However, there is flex with longer longitudinal distances, for example over eight feet. This means that when installed on an imperfect wall, the traditional wood crown will remain preferentially straight, as it is unable to flex over short distances, yet can flex a small amount (a couple inches) over longer distances such as eight feet. The result is a molding that appears straight to the eye, even if it is installed on a wall (and ceiling) with surface irregularities. Traditional wood crown molding that is installed over middle length irregularities (such as a waviness over a distance of one foot as an example) will not be able to flex and tightly follow the wave of the wall, but will remain largely straight against such middle-length waves. This may leave gaps where the molding remains straight against the wave, which gaps are conventionally filled with caulk to obscure the gap. With a properly installed traditional wood crown molding mounted on an irregular wall, the resulting appearance can be of a straight crown molding that draws the eye and deemphasizes the imperfections in the wall.

The present invention improves upon existing crown molding technologies by incorporating the ability to both install tightly and securely to a wall that is not perfectly straight and to maintain a preferentially straight crown molding face as seen in the room. This is accomplished by enabling two specific forms of flex to occur within the molding system; short-scale flex limited to an attachment portion of the molding, and a hinge-like action along the length of the attachment portion between (or incorporated within) the attachment portion and the decorative face, that allows the lower portion of the molding assembly to always achieve its desired location at the wall.

The hinge-like flex, in particular, is an improvement upon the crown molding system and method described in the inventors' recently issued U.S. Pat. No. 8,887,460, which molding is described as a simple pendulum, where the fastener, as it pierces the attachment flange, is above the center of mass of the entire molding system. In this simple pendulum system, the fastener serves as the pivot, and the molding structure as a whole will be constantly urged toward the wall, which is also the desired position of the crown molding. The invention requires the pivot to be at the fastener, and requires the molding to pivot as a whole, with no described accommodations for flex within the molding system that enables the pendulum effect in addition to the pivoting of the entire molding system.

The present invention, by moving the pivot of the simple pendulum system to within the molding structure itself, enables an improved molding system. While the short-scale and hinge-like flex actions occur, the structure of the molding is such that the decorative face of the molding is held in its desired position, with its lower portion against the wall and decorative face being held preferentially straight, similar to how traditional wood crown molding remains preferentially straight, even as the attachment portion flexes as needed when secured to an imperfect wall. The result of these improved parameters of flex, which are insulated from the decorative face, is a molding that, similar to traditional wood crown molding, remains primarily straight even as it is securely attached to a wall with irregularities from a perfect plane. Having a straight crown molding mounted to an imperfect wall is a desired design feature, as occupants within a room will have their eyes drawn to the straight crown molding, making the irregular wall less apparent.

The crown molding system and method described in the inventors' U.S. Pat. No. 8,887,460 offers improvements to the process of installing crown molding. However, certain wall irregularities would cause such crown molding system to install in an undesirable fashion. Further, the crown molding has no provisions for separable flex of the attachment portion, causing wall irregularities to be transmitted to the decorative face. This lack of separable flex of the attachment portion of the inventors' patented crown molding system is presented as a feature of the invention, since it allows the crown molding to "follow the uneven contour of the wall." However, the result of a crown molding flexing to match the contours of a wavy wall that is designed to be straight is fundamentally different from the result of the improved invention described here.

The molding described in U.S. Pat. No. 8,887,460 also does not include a hinge-like flex such as in the present inventors' improved crown molding system. Without this hinge effect, the molding described in U.S. Pat. No. 8,887,460 would install over certain irregularities which would force the bottom edge of the molding away from the wall, even though lower edge of the decorative face would still be continually urged against the wall surface. As an example, if the wall has an irregularity which protrudes outside of the wall below the fastener but above the lower edge of the decorative face, this irregularity would force the lower edge of the decorative face away from the wall. The simple pendulum action does urge the lower edge of the decorative face towards the wall, but without a hinge-like action within the molding such as in the present invention, the molding would rest against the protuberance leaving the lower edge of the decorative face away from the wall.

BRIEF SUMMARY OF THE INVENTION

The present invention provides an improved system and method for installation of crown molding that offers ease of installation compared to traditional crown molding installation, and also offers improvements that allow for secure installation of crown molding against a wall that contains irregularities and deviations from the intended plane. The invention comprises an installation portion and a molding portion, where the decorative face of the molding is entirely within the molding portion. The crown molding is installed by securing the attachment portion, which is above the center of mass of the entire molding system, firmly against a wall or vertical surface. The invention permits the attachment portion to flex as needed as it is firmly secured to the wall with its irregularities, without transmitting those irregularities, especially over short distances, to the decorative face. Since some wall irregularities may result in the lower edge of the decorative face being displaced away from the wall, the invention also incorporates a hinge-like flex either within the attachment portion, or at the junction of the attachment portion and the molding portion, which creates a pivot enabling a simple pendulum system that allows the lower edge of the decorative face to fall into place at the wall, constantly urged by gravity acting on the simple pendulum system. The rear of the molding portion may also have a relief space above where the lower portion contacts the wall to prevent any protruding wall irregularities from forcing the lower edge of the decorative face away from the wall.

An additional benefit of the present invention is that with the secure attachment of the installation portion to the wall or vertical surface, and enabling of a pivot and resulting reinforcement of the desired position of the molding portion and decorative face, any additional weight that is born by the molding portion of the system, such as when the molding acts as the perimeter of a suspended ceiling or contains electrical equipment and wiring, will additively reinforce the desired position of the lower edge of the molding portion at the wall. The present invention further improves installation of crown molding at corners where two walls meet. At corners, the invention joins the decorative faces in a single piece at the designed angle. The attachment portions corresponding to each decorative face do not meet at the corner, and are separated by at least a short distance that allows them to each be separately firmly secured to each respective wall close to the corner, and enabling each attachment portion to flex independently of the other and thus more easily absorb irregularities where the walls meet. This invention also offers the improvement that none of the methods of installation, reinforcing, joining different sections or installing corner pieces ever result in piercing or otherwise disturbing the decorative face, while retaining a consistent decorative face profile and shape around the entire installation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE INVENTION

The following detailed description is of the best mode or modes of the invention presently contemplated. Such description is not intended to be understood in a limiting sense, but to be a non-limiting example of the invention presented solely for illustration thereof, and by reference to which in connection with the following description and the accompanying drawings one skilled in the art may be advised of the advantages and construction of the invention. Wherever possible, like reference numbers have been utilized to refer to like elements or features of the invention throughout the different embodiments illustrated herein.

The present molding system is adapted for use with an irregular wall. By irregular wall, what is meant is a wall that has variations from its designed plane (if referring to a curved wall, then variations from that curved design). These variations are known to exist in all walls, even under excellent construction conditions, and may be present in new construction and/or introduced over time due to settling, effects of climate variations, etc. Most commonly, a wall that is designed to be straight for a certain length will always have some unintended variations from a planned geometrically perfect plane.

The molding system of the present invention is designed such that it can be used with irregular walls that are regular enough to pass inspection and be considered acceptable versus the geometrically perfect design, and offer improvements over the current state of the art. When the crown molding of the present invention is mounted to an irregular wall, the mounting is securely attached, yet the decorative face is preferentially straight even as the non-visible components of the molding system, such as the attachment portion, absorb the flex required to firmly mount the molding system to said irregular wall.

Figure 1:
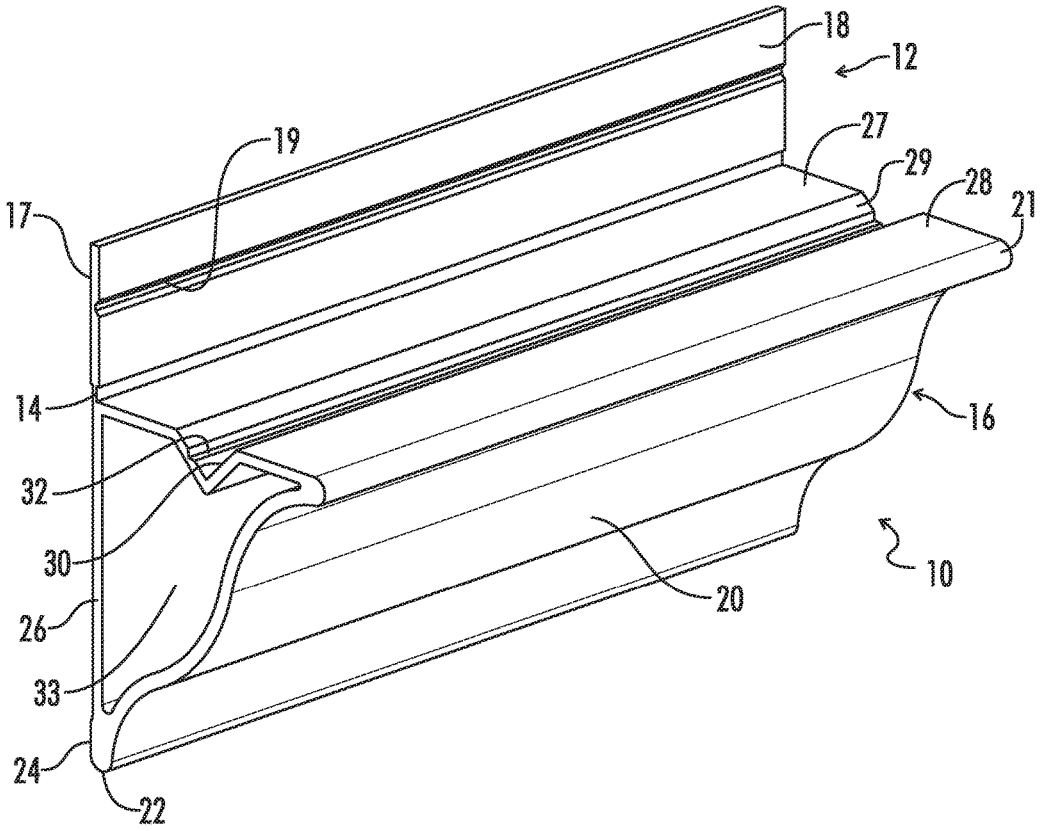
FIG. 1 is a perspective view from the front of a crown molding section in accordance with the present invention.
Figure 2:
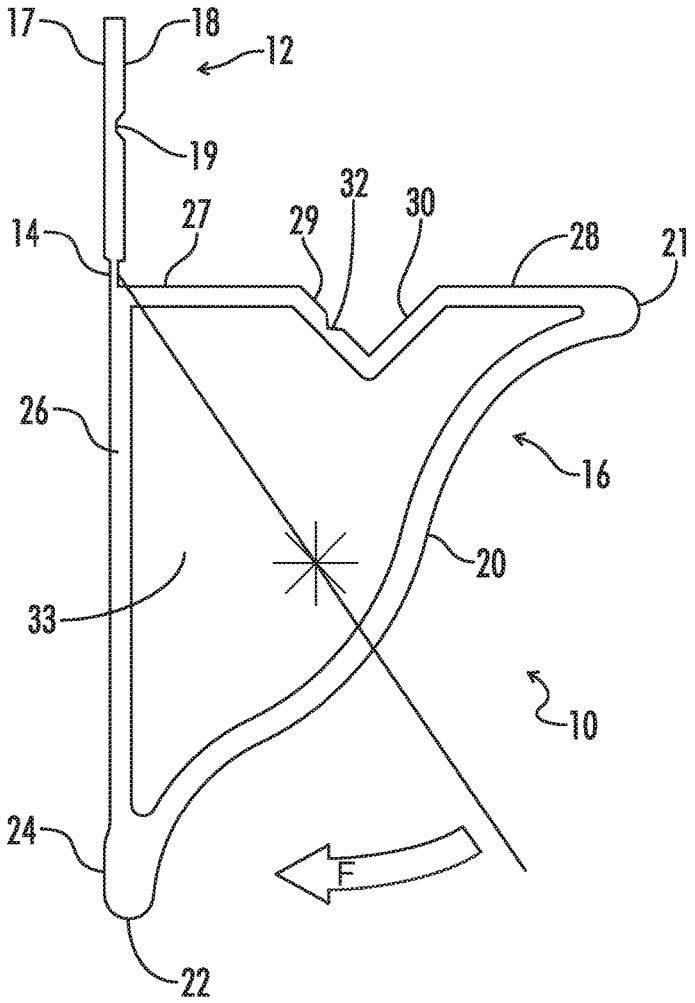
FIG. 2 is a side diagrammatic view of the crown molding section shown in FIG. 1.
Figure 3:
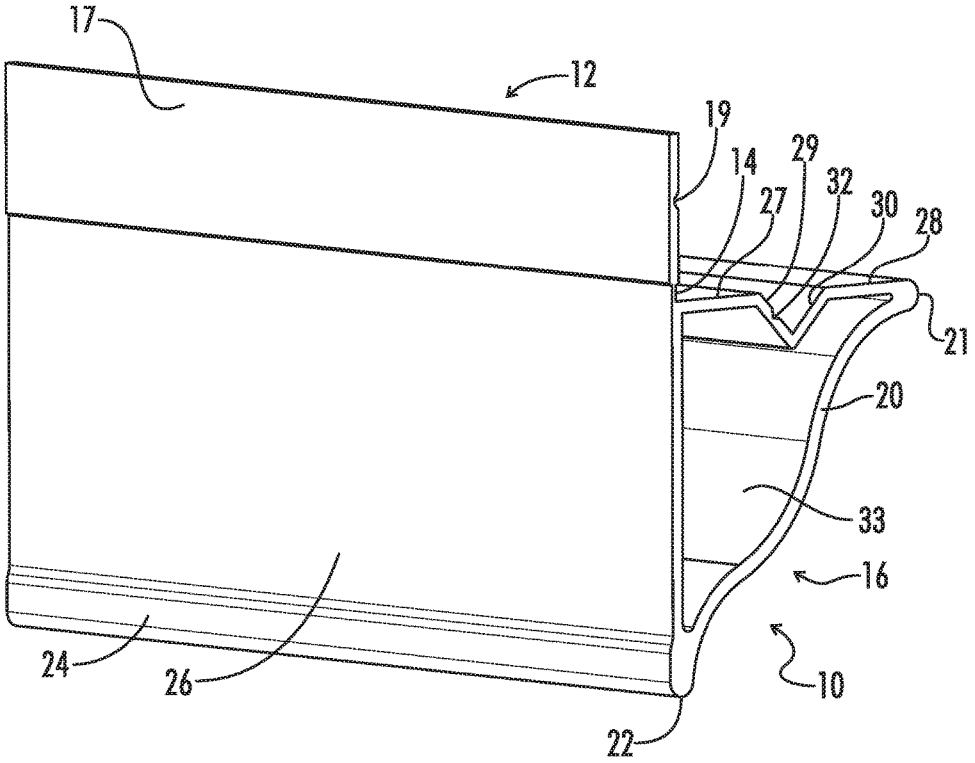
FIG. 3 is a perspective view from the rear of the crown molding section shown in FIG. 1

FIGS. 1-15 illustrate several embodiments and features of a crown molding system and assembly in accordance with the present invention. Referring now in particular to FIGS. 1-3, a straight crown molding section 10 forming part of the crown molding system and assembly is shown. Crown molding section 10 includes an attachment portion 12 which as described below serves as the primary means for securing the molding section 10 to a support surface such as a building interior wall surface, a hinge 14 extending along an edge of attachment portion 12, and a decorative molding portion 16 secured to hinge 14. Attachment portion 12 has a wall contacting or wall attachment surface 17, and an opposite facing surface 18 in which a fastener location groove 19 is provided extending longitudinally for positioning and driving a piercing type fastener such as a screw or other attachment member through the attachment portion 12 into the wall or a stud supporting the wall in order to secure the molding section 10 to the wall. Groove 19 is the location for the primary fastener used to attach the molding system of the present invention to a wall. Alternatively, in place of a piercing fastener, a suitably strong adhesive may be applied to the rear attachment surface 17 of attachment portion 12. If required, an additional fastener may be applied through attachment portion 12 either above or below groove 19 along the same vertical line to increase the adhesion strength of the molding section 10 to a wall framing member.

Hinge 14 extends preferably continuously between the attachment portion 12 and the molding portion 16. Molding portion 16 includes a decorative face 20 having an upper end 21 and a lower end 22, a lower wall contacting surface 24, a back member 26 extending between lower attachment surface 24 and hinge 14, an inner horizontal member 27 connecting at a right angle to back member 26, an outer horizontal member 28 extending from the upper end 21 of decorative face 20, and a pair of oppositely inwardly angled members 29 and 30 which form a "V" shaped member connecting between inner and outer horizontal members 27 and 28. A screw or other fastener location groove 32 is provided in angled member 29 which is used in a manner to be described to secure sections of the molding 10 as well as other components of the molding system together in an end-to-end relationship and reducing the likelihood of any gaps in the decorative face 20 where the sections of molding 10 meet. In addition, the "V" shape formed by inwardly angled members 29 and 30 provides for the interconnection screw location such that a screw or other fastener does not violate the horizontal plane formed by the surfaces of inner and outer horizontal members 27 and 28 for any ceiling components when installed or supported by the molding assembly. Finally, an opening 33 extends longitudinally in the body molding or portion 16 between decorative face 20, back member 26, horizontal members 27 and 28, and angled members 29 and 30, which together form preferentially stiff molding portion 16.

Attachment portion 12 is preferably constructed to flex in any direction as needed to follow the contour of, and be secured to, an irregular wall surface. As such, attachment portion 12 is flexible in a three-dimensional sense or in each of the x, y, and z axes. As best shown in FIG. 2, attachment surface 17 of attachment portion 12 and lower wall attachment or contact surface 24 of decorative body section 16 are both facing rearwardly and in one embodiment are substantially aligned in the same vertical plane. Contact surface 24 may have a generally flattened surface as shown in FIG. 2, while in other embodiments as will be shown may be rounded or differently shaped so as to have different wall contacting surface areas. The lower edge 22 of the decorative face 20 is shown in FIG. 2 as having a rounded shape or radius which provides a shadow that will obscure imperfections in the wall surface against a straight molding section. It will be understood, however, that lower edge 22 may been differently shaped in order to provide alternative desired decorative patterns and appearances.

In addition, hinge 14 and back member 26 are spaced or offset towards the decorative face 20 from the attachment surface 17 and lower attachment surface 24. As a result, when attachment portion 12 is secured to a wall having a substantially geometrically perfect planar wall surface, in which the plane is perfectly straight and plumb, and both attachment surface 17 and lower attachment surface 24 are in contact with the wall surface, the rearwardly facing surfaces of hinge 14 and back member 26 will not contact the wall surface. Instead, there will be gap or space formed which allows for variations in the wall surface such that lower attachment surface 24 can be pivoted into contact with the wall surface where otherwise the rearwardly facing surfaces of hinge 14 and back member 26 might impede or interfere with such contact. Back member 26 may also flex as needed, and may include one or more openings, as in an open extrusion, as long as the structure is maintained through all installation and normal use activities.

Hinge 14 operates in a manner similar to a piano hinge situated between attachment portion 12 and molding portion 16 in that hinge 14 serves as a flex point which allows the molding portion 16 and decorative face 20 of the molding section 10 to pivot or fall into the wall surface at its desired location. In FIGS. 1-3, hinge 14 is shown as a narrowing of the material of the molding section extrusion, where the material itself, using existing materials and engineering practices, is provided with a flexibility necessary to allow force F, shown by the arrow in FIG. 2, to act to urge lower wall contacting surface 24 of molding portion 16 against the vertical wall surface, even when attachment surface 17 of the attachment portion 12 is tightly drawn or held to the wall by one or more fasteners passed through the attachment portion 12 into the wall, or by an adhesive with multiple adhesion points within surface 17. An adhesive may also be applied to substantially the entire area of attachment surface 17 such that attachment surface 17 and the entire attachment portion 12 of the molding section 10 is immobile, yet hinge 14 allows for a pivot action of the decorative body portion 16 since the hinge 14 allows for independent pivoting movement of the body portion 16 to ensure that the lower wall contacting surface 24 contacts the wall.

Where the molding section 10 is mounted on a geometrically perfect plane of a wall by attachment portion 12, the lower wall contacting surface 24 would also be in contact with the wall surface with no flex required at hinge 14. However, the present invention allows for the molding assembly to be tightly and securely attached to a wall surface at attachment surface 17, and any irregularities in the wall are absorbed by the ability of the attachment portion 12 of the molding system to flex with the wall, while the molding portion 16 of the molding assembly moves preferentially less, and lower wall contacting surface 24 always maintains contact with the wall. Additionally, body portion 16 is constructed such that the decorative face 20 presents a desirable straight appearance to the room even if the molding assembly is mounted on an irregular wall. It is noted that the designed placement of the decorative face (spring angle, etc. in regular crown molding) is maintained as well as its straightness.

In the embodiment shown in FIGS. 1-3, both horizontal members 27 and 28 are also preferentially thick. This allows the molding assembly to also act as the perimeter member of a suspended ceiling grid system. As such, it is preferable that the horizontal surfaces of members 27 and 28 remain flat within the horizontal plane of the ceiling, so that grid members and ceiling tiles that rest on the molding system are flat and neat in appearance. It is further noted that any hardware outside of the molding system and attachment hardware that rests on horizontal members 27 and 28 or is otherwise attached to any portion of the molding assembly below hinge 14, will add to the force F shown in FIG. 2 and serve to reinforce the desired placement of lower contact surface 24 against the wall.

The molding assembly of the present invention may be constructed of a composite material including fiber reinforced polymers (FRP) in order to retain the flexibility of hinge 14 while maintaining the needed strength against sheering at such point. Existing engineering practices may apply FRP methods to allow flexibility at hinge 14 while maintaining necessary strength. Existing methods and practices may also be leveraged to harden or use materials having different levels of flexibility, such that the decorative face 20 may be formed of a stiffer material than the material forming at least hinge 14. Differential stiffness can ensure that the decorative face of the molding section along its distance from the wall to the top of the decorative face remains stiff and in its desired placement. The molding assembly may be manufactured using FRP using a process such as pultrusion. FRPs made using pultrusion can be designed, using standard methods and practices related to pultrusion and FRPs, to provide the desired strength and flexibility characteristics of the molding assembly. In particular, FRP can be used to allow flex at the hinge while also preventing shear at the hinge. Another FRP practice could be used to create a cavity immediately behind the decorative face of the molding body, running nearly the length of the decorative face from top to the bottom, which cavity is filled, post pultrusion, with a foam that, after filling the cavity, becomes rigid. Such a standard practice has long been used to strengthen tool handles and the like. Pultrusion combined with a rigid foam core immediately behind the decorative face would be ideal in certain embodiments in which the decorative face would be preferentially stiff even though the surrounded pultruded material would allow the desired flex for secure attachment to an irregular wall. A rigid foam core could also be applied to a standard extrusion with the same result.

Figure 10:
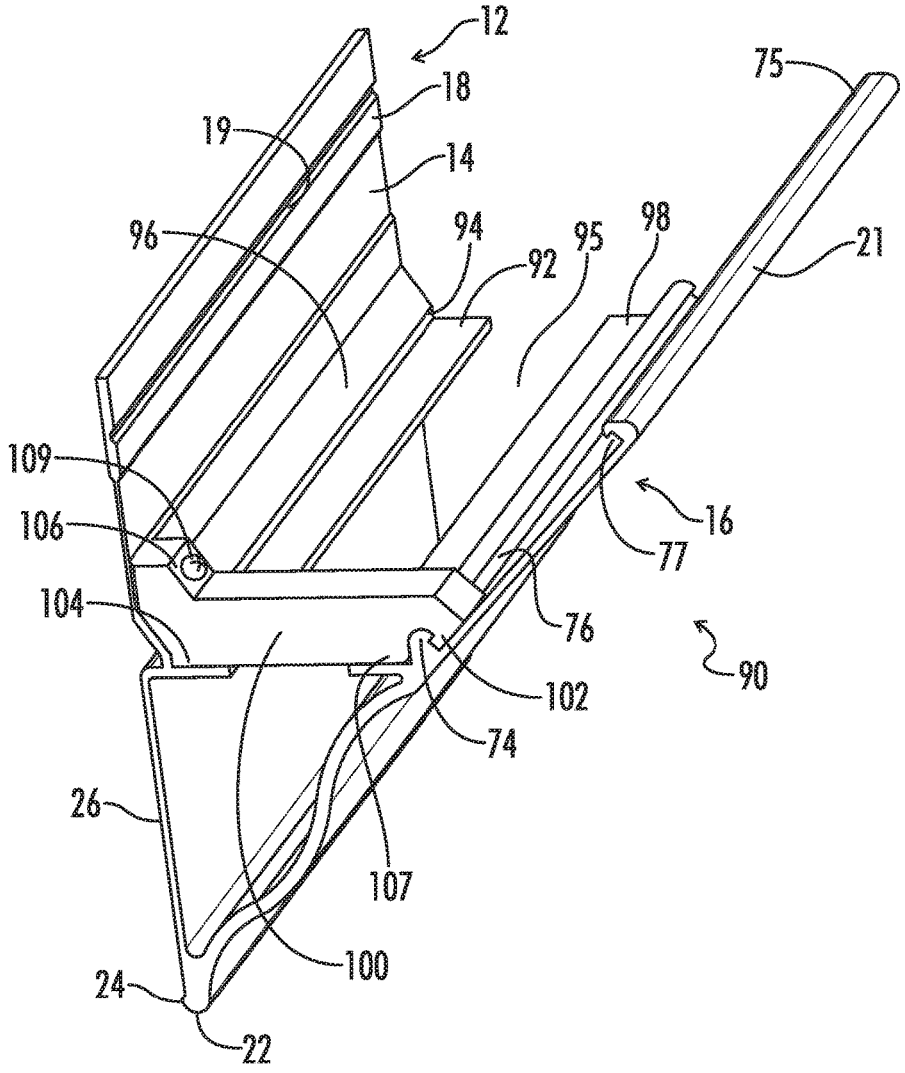
FIG. 10 is a perspective top side view of another embodiment of the crown molding assembly of the present invention.
Figure 11:
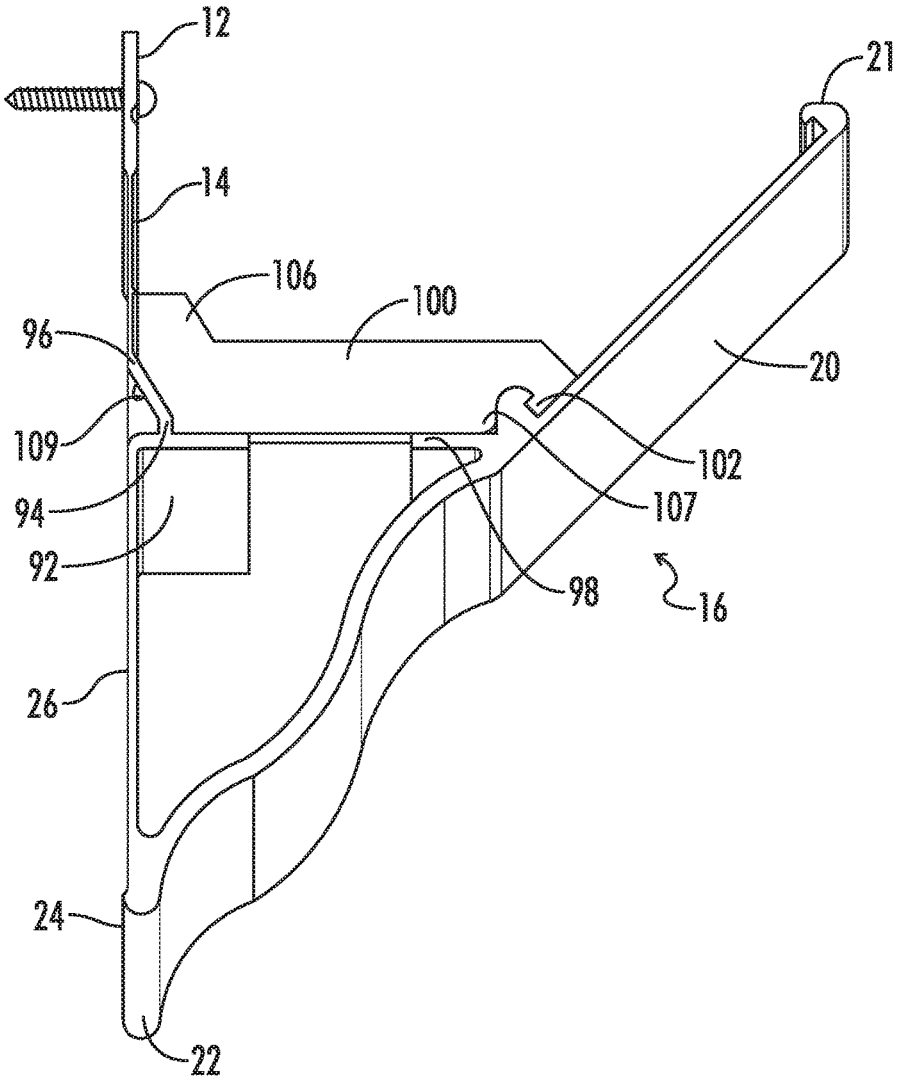
FIG. 11 is perspective bottom side view of the molding section shown in FIG. 10.
Figure 12:
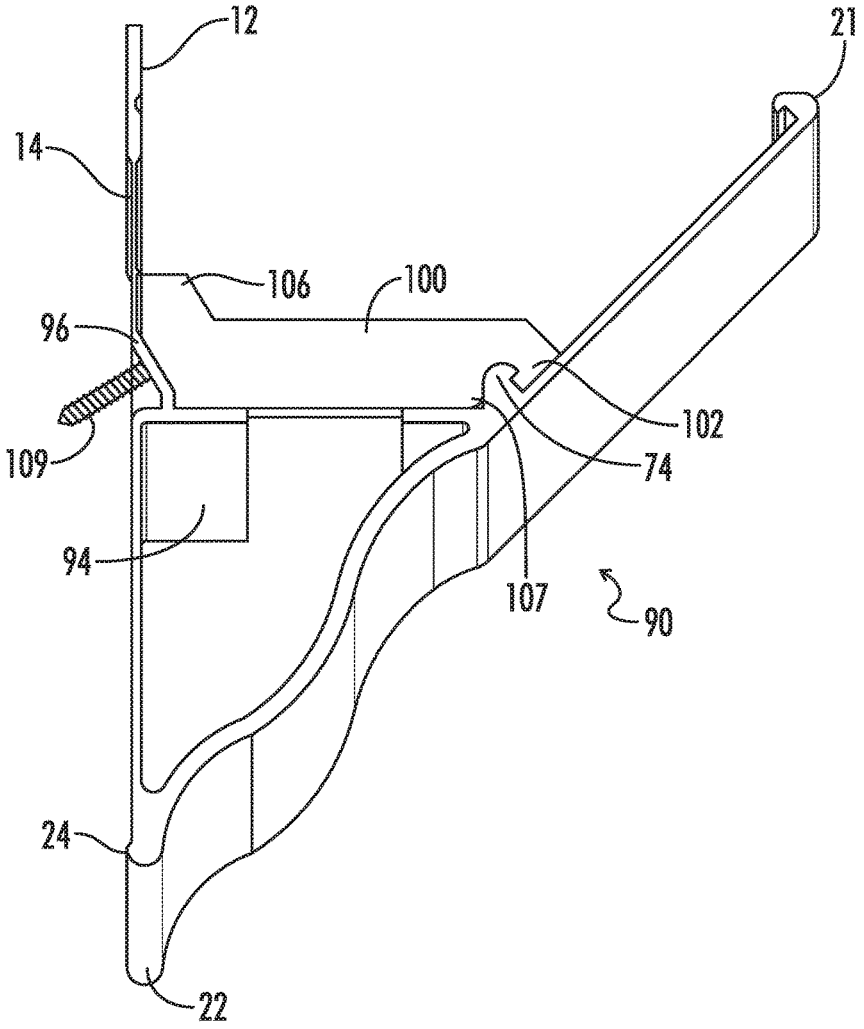
FIG. 12 is similar to FIG. 11 illustrating a different fastener means.

In addition, as a result of hinge 14 enabling a pivot which forces the lower wall contacting surface 24 against the wall even when attachment portion 12 is securely attached to the wall and immobile, conditions which cause movement of the wall could enable the hinge 14 and allow unwanted movement of the molding system restricted to lower wall contacting surface 24 pivoting away from the wall. This might occur during an earthquake, when movement of the wall itself could cause the molding assembly to pivot away from the wall. This might also occur if the molding assembly is mounted on a large watercraft such as a cruise or cargo ship, where heavy seas could change the wall angle such that the simple pendulum force changes significantly enough to cause contact area 24 to move away from the wall. This movement could be prevented by applying an adhesive to the lower wall contacting surface 24. Alternately, some embodiments of the molding assembly, at least one of which is illustrated in FIGS. 10-12, may allow for a screw to be driven through the vertical molding assembly surface from above and behind the decorative face, but below the hinge, where that screw is not for installation or structural support in a stable room, but to prevent lower contact surface 24 from separating from the vertical surface to which it is mounted in a situation of a moving room. Any adhesive or screw or nail fasteners applied to the lower contact portion would not be considered to play a structural role in installing the molding, but rather being limited to preventing unwanted movement under conditions of a moving wall.

Hinge 14 may also provide a structural break from the attachment portion and attached wall with respect to acoustics, and particularly transmission of impact noise and mechanical vibrations from the wall to which the molding system is attached, and from ceiling grid members to the attached wall. This is an improvement over standard metal perimeter moldings, which are rigid and rigidly attached to the wall. Most construction standards require at least some suspended ceiling grid members to be securely attached to the perimeter molding, especially in areas of high seismic risk. Existing practices, materials and methods have been implemented in suspended ceiling tiles, and they can substantially attenuate noise, particularly airborne noise. However, when reducing impact noise and mechanical vibration, it is typically desirable to provide a structural break to prevent direct sound transmission from one building element to another. Suspended ceiling grid members frequently contact, if not support, mechanical systems such as HVAC components. The present invention provides an incomplete, but substantially improved, structural break between a ceiling grid and the walls to which it is attached by attaching grid members to the crown molding system at horizontal members 27 and 28.

Figure 4:
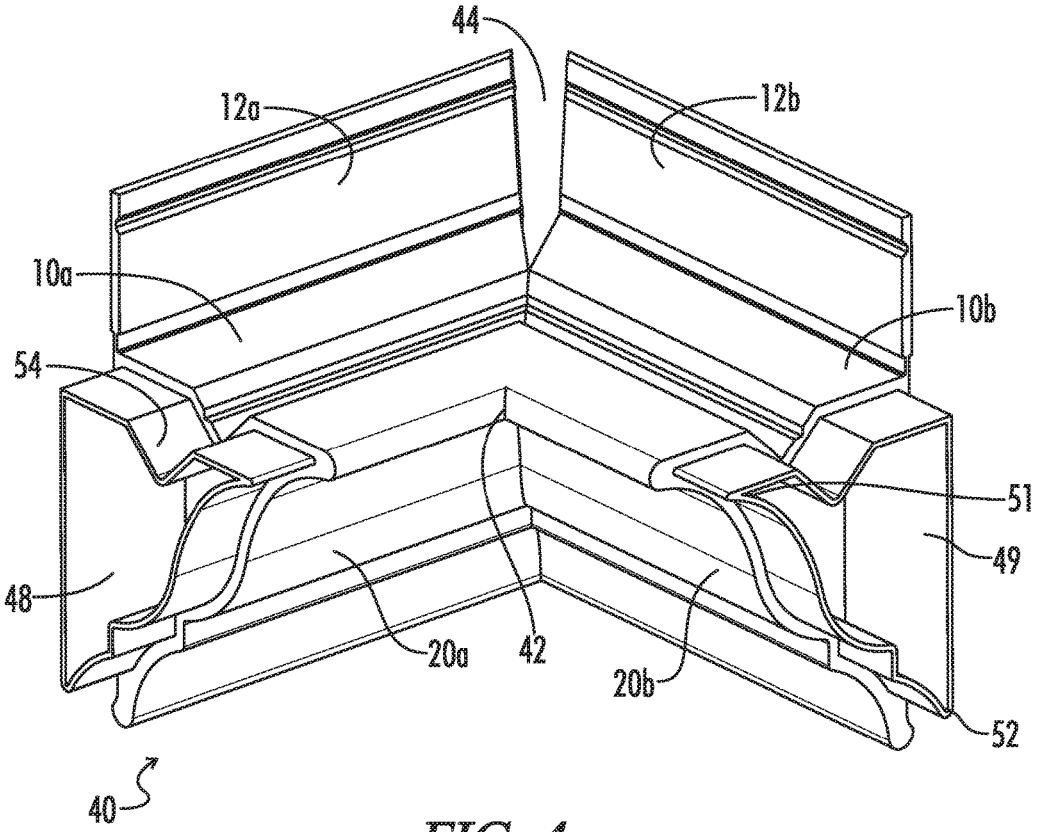
FIG. 4 is a perspective front view of an inside corner section of the crown molding assembly.
Figure 5:
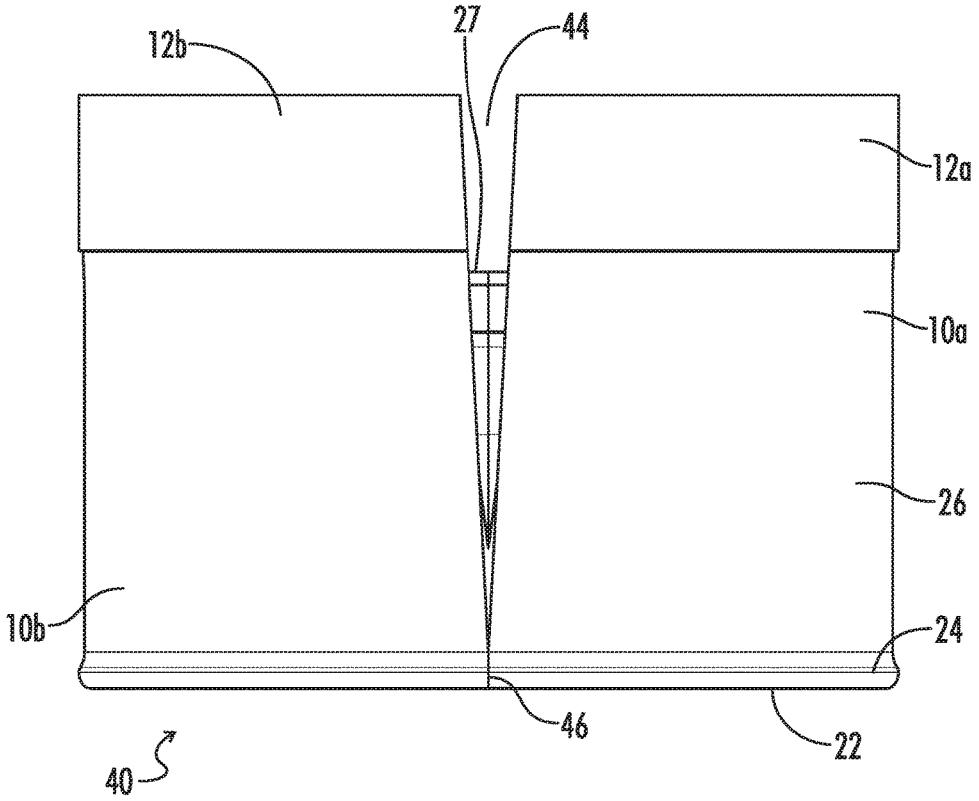
FIG. 5 is a perspective rear view of the inside corner section shown in FIG. 4.

As illustrated in FIGS. 4-7, the molding assembly of the present invention also includes pre-made inside and outside corner members 40 and 60, respectively. Referring now in particular to FIGS. 4-5, an inside corner assembly 40 is shown which includes two short crown molding sections 10*a* and 10*b* having a structure which is similar to that described above with respect to FIGS. 1-3. Molding sections 10*a* and 10*b* are joined such that the decorative faces 20*a* and 20*b* intersect and are substantially at a right angle with respect to each other, forming an inside corner. The intersecting decorative faces 20*a* and 20*b* of inside corner member 40 are joined along their full length at intersection 42 from the top to bottom edge of the decorative faces.

However, a gap 44 is provided at the inside corner between attachment portions 12*a* and 12*b*. Gap 44 will typically extend at least partially between the back members 26 and horizontal members 27, as shown in FIG. 5. Gap 44 is provided to allow for the molding corner assembly 40 to be positioned in a finished inside wall corner such that lower wall contact surface intersection 46 of molding sections 10*a* and 10*b*, shown in FIG. 5, can be adjustably positioned on a wall so that the molding assembly has a best finished appearance. Gap 44 thus allows the attachment portions 12*a* and 12*b* to be securely attached at the particular location they contact the wall surface, and in the manner previously described with respect to a straight molding section 10, may flex to an imperfect wall corner without disrupting the placement of wall contact surface intersection 46. As a result, the decorative face intersection 42 and bottom edge intersection 46 result in the appearance of a perfectly constructed crown molding intersection regardless of any imperfection in the walls and wall corner to which the molding is attached.

Also illustrated in FIGS. 4-5 are a pair of alignment insert members 48 and 49 which are designed to be positioned in the open ends 33 of aligned corner and straight sections of the molding assembly in order to secure the adjacent sections together. Inserts 48 and 49 preferably have the same shape as the interior shape of open ends 33 but with slightly lesser dimensions so that the inserts can slidingly fit in the open ends 33 of the molding sections and providing a tight fit between the sections. In particular, the upper and bottom edges 51 and 52 of the alignment inserts 48 and 49 must be dimensioned to fit precisely in the molding sections to ensure a proper alignment of decorative face 20, when two separate molding assembly pieces intersect. In an embodiment, the alignment inserts 48 and 49 may be provided as separate pieces which are secured in the ends of both aligned assembly pieces, or in another embodiment may be integrally formed as part of the inside corner member 40.

In connecting sections of the molding assembly using the alignment insert, the V-shaped surface 54 of the alignment inserts will be pierced by a fastener which is also passed through the screw location groove 32 in inwardly angled member 29 of the molding sections. The alignment inserts will force the alignment of the decorative faces 20 of connected pieces of the crown molding assembly, to align with the decorative faces 20*a* or 20*b* of the inside corner assembly 40. A stand-alone alignment insert may be used to join two straight molding sections 10 together without any built in alignment inserts. In other possible components of the molding assembly, the molding sections may also include a gap to allow for a transition to a standard metal perimeter molding, or where it is desired to have a finished appearance similar to where regular crown molding would be terminated along a straight wall the molding assembly may include a built in termination of a straight section of this crown molding assembly.

In certain embodiments, it may be advantageous to extend gap 44 along the back member so that the lower contact surfaces 24 do not actually meet each other. This can be advantageous to allow for known artifacts of drywall finishing at a corner, such as a corner bead which is often sticking out a small amount. As long as the bottom edges 22 of the molding sections meet at intersection 46 shown in FIG. 5, the decorative face intersection 42 will appear uninterrupted to the room, since in the presently described embodiment the molding section has a rounded bottom edge such that the part of the molding assembly behind the bottom edge 22 is by design obscured by shadow and therefore not necessary for the inside corner section to have a finished appearance.

Figure 6:
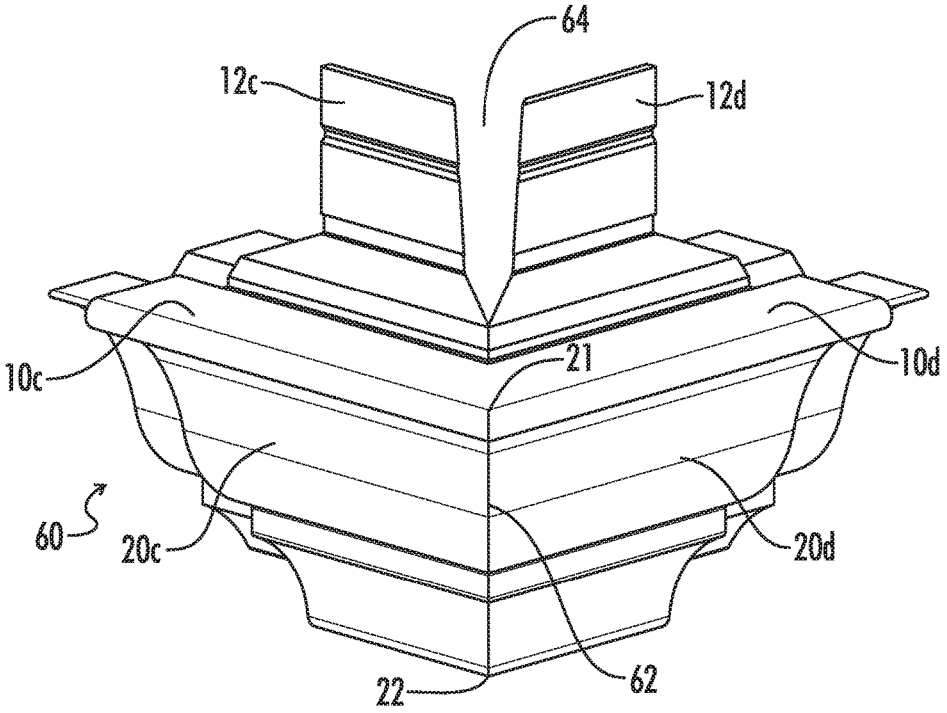
FIG. 6 is a perspective front view of an outside corner section of the crown molding assembly.
Figure 7:
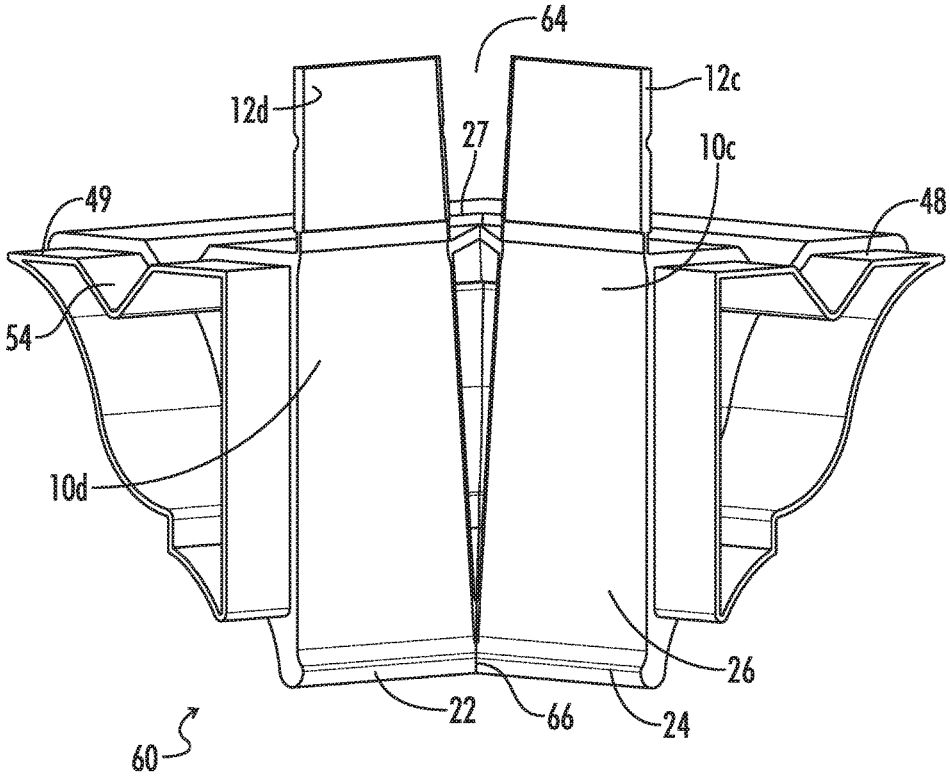
FIG. 7 is a perspective rear view of the outside corner section shown in FIG. 6.

FIGS. 6 and 7 illustrate an outside corner assembly 60, which similar to inside corner assembly 40 includes two short crown molding sections 10*c* and 10*d* having a structure which is similar to molding section 10 described above with respect to FIGS. 1-3. Molding sections 10*c* and 10*d* of outside corner assembly 60 are joined such that the decorative faces 20*c* and 20*d* intersect and are substantially at a right angle with respect to each other, forming an outside corner. The intersecting decorative faces 20*c* and 20*d* of outside corner member 60 are joined along their full length at intersection 62 from the top to bottom edge of the decorative faces. However, a gap 64 is provided at the outside corner between attachment sections 12*c* and 12*d* of outside corner assembly 60. Gap 64 will typically extend at least partially between the back members 26 and horizontal members 27, as shown in FIG. 7. Gap 64 allows the molding corner assembly 60 to be positioned in a finished outside wall corner such that lower wall contact surface intersection 66 of molding sections 10*c* and 10*d*, shown in FIG. 7, can be adjustably positioned on a wall so that the molding assembly has a best finished appearance. Gap 64 thus allows the attachment portions 12*c* and 12*d* to be securely attached at the particular location they contact the wall surface, and in the manner previously described with respect to a straight molding section 10 may flex to an imperfect wall corner without disrupting the placement of wall contact surface intersection 66. As a result, the decorative face intersection 62 and bottom edge intersection 66 result in the appearance of a perfectly constructed crown molding intersection regardless of any imperfection in the walls and wall corner to which the molding is attached.

Alignment insert members 48 and 49 are also provided with outside corner assembly 60 and as with inside corner assembly 40 may either be integrally formed as part of the outside corner assembly or may be provided as separate pieces which are secured in the ends of both aligned assembly pieces. In connecting other crown molding sections of the molding assembly to the outside corner assembly using the alignment inserts 48 and 49, the V-shaped surface 54 of the alignment inserts will be pierced by a fastener which is also passed through the screw location groove 32 in inwardly angled member 29 of the molding sections. The alignment inserts will force the alignment of the decorative faces 20 of connected pieces of the crown molding assembly, to align with the decorative faces 20*c* or 20*d* of the outside corner assembly 60. In certain embodiments, it may be advantageous to extend gap 64, shown in FIG. 7, along the back member 26 so that the lower contact surfaces 24 do not actually meet each other, which as discussed above with respect to the inner corner assembly 40 can be advantageous to allow for known artifacts of drywall finishing at a corner, such as a corner bead which is often sticking out a small amount. As long as the bottom edges 22 of the molding sections meet at intersection 66 shown in FIG. 7, the decorative face intersection 62 of the outside molding assembly 60 will appear uninterrupted to the room, since in the presently described embodiment the molding section is shown having a rounded bottom edge such that the part of the molding assembly behind the bottom edge 22 is by design obscured by shadow and therefore not necessary for the inside corner section to have a finished appearance. However, in other embodiments in which the molding assembly does not have a rounded bottom edge, the same general principles for aligning the inner and outer corner molding assemblies will apply.

It will be understood therefore that the pre-made inside and outside corners of the present inventors' crown molding assembly can be made using the same principles of the present invention, namely that the attachment portion of the molding system pre-made corner can flex to match an irregular corner while the decorative face of the pre-made corner remains preferably in position. Further benefit is in maintaining a perfect intersection between the two sections of molding that meet in said corner, even better than a cope cut or a miter cut. Corner pieces of this type can be pre-made for any number of corner angles, most commonly 90 degrees as illustrated.

Figure 8:
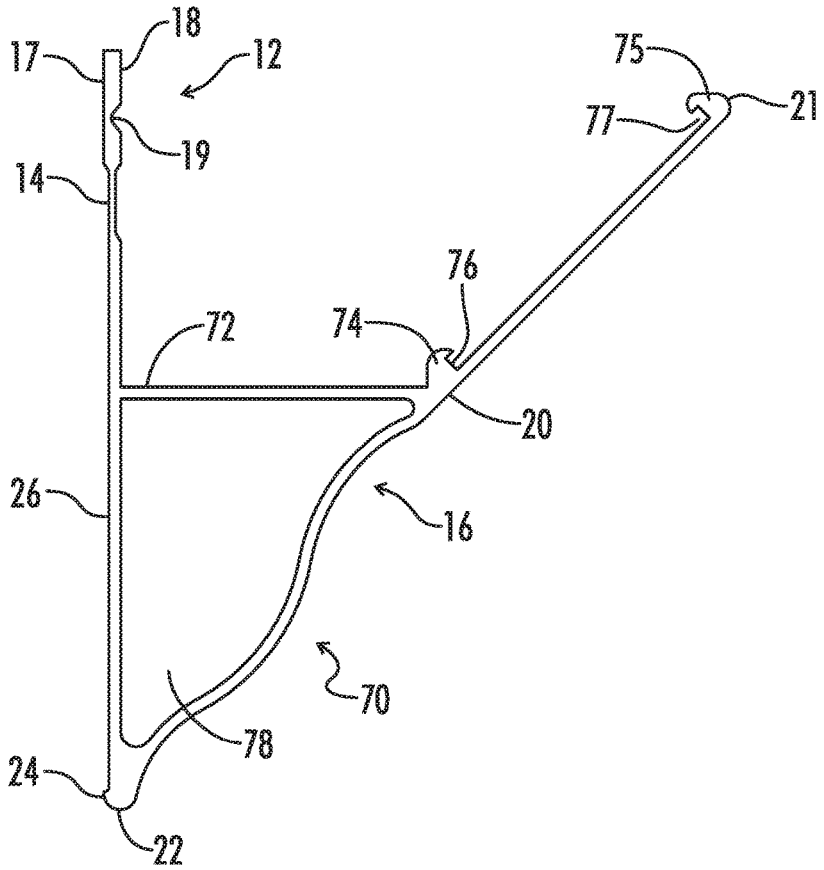
FIG. 8 is a side diagrammatic view of another embodiment of the crown molding assembly of the present invention.
Figure 9:
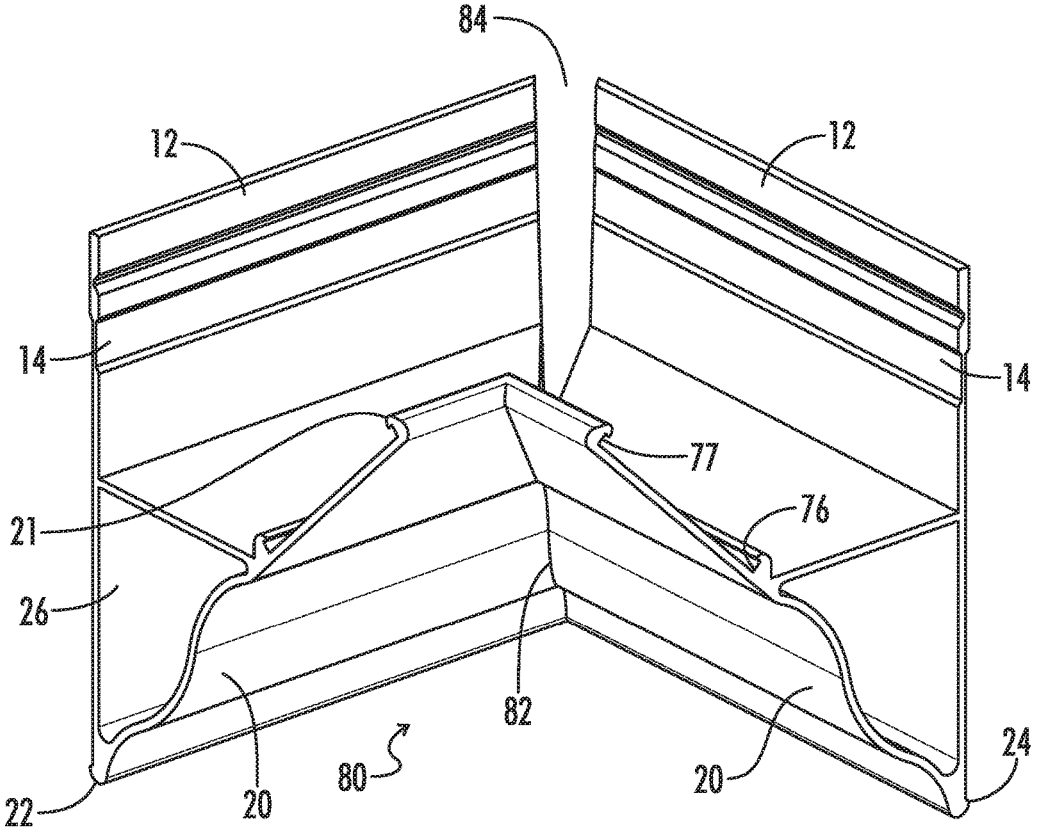
FIG. 9 is a perspective front view of an inside corner section for use with the crown molding section shown in FIG. 8.

FIGS. 8-9 illustrate another embodiment of the crown molding assembly of the present invention. Molding section 70, similar to molding section 10 described above with reference to FIGS. 1-3, includes an attachment section or flange 12 for securing the molding section 70 to a support surface such as a building interior wall surface, a hinge section 14 connected on one end to attachment section 12, and a decorative body section 16 secured to hinge section 14. Attachment section or flange 12 has a wall contacting or wall attachment surface 17, and an opposite facing surface 18 in which a fastener location groove 19 is provided extending longitudinally for positioning and driving a piercing type fastener such as a screw or other attachment member through the attachment section 12 into the wall or a stud supporting the wall in order to secure the molding section 70 to the wall. Groove 19 is the location for the primary fastener used to attach the molding system of the present invention to a wall. Alternatively, in place of a piercing fastener, a suitably strong adhesive may be applied to the rear attachment surface 17 of attachment section 12. If required, an additional fastener may be applied through attachment flange 12 either above or below groove 19 along the same vertical line to increase the adhesion strength of the molding section 70 to a wall framing member.

In molding section 70, hinge section 14 is shown as being longer than in molding section 10 shown in FIG. 2, but still serves as a flex point and extends preferably continuously between the attachment section 12 and the body section 16. Molding body section 16 includes a decorative face 20 having an upper edge 21 and a lower edge 22, a lower wall contacting surface 24, a back member 26 extending between lower attachment surface 24 and hinge member 14, and a horizontal member 72 connecting at a right angle to back member 26 and to the rear surface of the decorative face 20. Horizontal structural member 72 is positioned below the upper edge 21 of the decorative face 20, unlike horizontal members 27 and 28 in FIG. 2.

In addition, a pair of spaced apart tabs 74 and 75 are provided on the inner surface of the decorative face 20 above the location of horizontal member 72. Tabs 74 and 75 form upper and lower notches 76 and 77, respectively, which notches open towards each other such as to provide a slot for placement of an alignment insert, not shown. More particularly, the alignment insert will be sized to extend between and fit in the notches 76 and 77 along the rear surface of decorative face 20, and ensures that the middle portions of decorative face 20 are properly aligned when adjacent molding sections are installed and secured together in an end-to-end relationship.

An internal cavity 78 is formed extending longitudinally in the molding section 70 in the space bordered by the lower surface of horizontal member 72, the rear surface of the decorative face 20 below horizontal member 72, and the inner surface of back member 26. Such internal space is protected by the structure of the molding. Another difference between molding section 70 and the previously described molding section 10 is in molding section 70, the screw location groove 19, and resulting screw location, is below the uppermost edge 21 of the decorative face 20 of the molding portion. This may be desirable to ensure that the screw cannot be seen, and it is noted here that the screw location 19, and also the attachment portion 12, may extend as low as desired relative to the decorative face 20, as long as the pivot that enables the hinge-like flex is above the center of mass of the molding portion 16. The location of the pivot above the center of mass of the molding portion 16 (the pendulum in this simple pendulum model) enables the desired force urging the lower edge 22 of the molding into the wall.

The hinge portion 14 includes a flex point which as in the previously described embodiment is designed to allow the attachment flange 12 to be drawn tightly to an irregular wall, and for the attachment flange 12 to flex to meet those irregularities and provide a secure attachment for one or more fasteners through attachment flange 12 and into the wall onto which the crown molding system is attached, presumably into a stud or other framing member to facilitate secure attachment. The hinge portion prevents those irregularities from transmitting from the attachment flange 12 to any other components of the molding assembly below the hinge portion 14. As such, the hinge portion 14 may flex in any direction necessary to facilitate the flex needed as a result of secure attachment of the attachment flange to an irregular wall. In addition, the flex point acts as a pivot point for the improved molding assembly to pivot into the wall, most importantly, at lower wall contact surface 24. By separating the attachment point and flex point, the molding assembly can be securely attached by any method that is useful, including adhesive, or multiple attachments in profile (multiple screws, one directly above the other), and since flex point provides the pivot, the molding will still behave as a simple pendulum with lower wall contact surface 24 being urged into the wall to which the molding system is attached. The hinge portion 14 and resulting flex action can be created by using thinner material at hinge portion 14, or using a different material, or a different curing process that imparts greater flexibility to hinge portion 14, or any other method in the art to enable the described flex at hinge portion 14. As indicated above, fiber reinforced polymer (FRP), either by pultrusion for straight sections, or molded for premade corners, may be used, or any more suited methods known in the art. FRP, both pultruded and molded, can also use fiber content, type, orientation and other parameters to affect different mechanical properties, including within one pultruded profile. Thus, one pultruded profile could exhibit increased flexibility in one portion of the profile and decreased flexibility in another portion of the profile, using methods known in the art of FRP and pultrusion.

In addition, lower edge 22 of decorative face 20 has a curved profile. More particularly, the decorative face 20 curves down and towards the absolute bottom of the portion 16, which curve continues around to lower wall contact surface or point 24. In cross section, the bottom of the molding section 70 is defined by a semicircle, or bottom half of a circle, with lower edge 22 and lower wall contact surface 24 located on the semicircle which blends in smoothly into the rest of the decorative face travelling up to the top edge 21 of the decorative face. The semicircle is provided because it creates a shadow between the bottom of the molding and the wall. When in a room with this molding system 70 installed, the semicircle, will be readily visible under normal lighting conditions, and the molding area between lower edge 22 and contact surface 24 will be obscured by shadow, and difficult to see. Also, the molding assembly will cast shadow on the wall, specifically the area where lower wall contact surface 24 contacts the wall and slightly below that, likely to the point horizontal to lower edge 22. This is very useful because all walls have some manner of imperfection, and deviate from a perfect geometric plane. Since, by design, the decorative face 20 remains preferentially straight when installed on an imperfect wall, there will be gaps along the wall wherever those imperfections are as lower contact surface 24 remains preferentially straight. The present design employs the shadow behind the back quarter of the bottom semicircle (from lower edge 22 to lower contact surface 24) to obscure these gaps. Further, since the molding may grab the eye as a decorative element, the crisp straight lines of the preferentially stiff decorative face may cause the viewer to see the straightness of the molding and extrapolate that straightness to the wall, even when there are fluctuations in the wall. This is especially true when the area where the straight molding meets the wall, which otherwise would make gaps visible and apparent, is hidden in shadow and not visible to the room occupant.

In order to manufacture the crown molding of the invention, the material must be flexible at least at flex point or hinge portion 14 and attachment flange 12 must also be flexible. However, in keeping with the overall invention, the decorative face must remain preferentially straight, maintaining the desired form of the molding even when attached to an irregular wall. Because the decorative face 20 is not supported with structure in the present embodiment above horizontal structural member 72, the material and/or processes used to form molding section 72 must be strong enough to ensure the desired placement of decorative face as well as all other components of the molding system that are dependent upon decorative face 20 for support. Pultrusion is a preferred manufacturing method, since very complex profiles can be made with more than the strength required to maintain decorative face 20 in a desired position without direct support of a structural member. Further, the flex point 14 can be designed using a specific fiber structure that imparts flexibility, yet maintains shear strength in the vertical direction. A different cure, in addition to different fiber designs, may be used for either flex point 14 or the entire attachment flange 12 such that there may not be a shape defining flex point 14, but the different cure process would result in increased flexibility of either or both attachment flange 12 as a whole, and/or flex point 14.

FIG. 9 is a front view of an inner corner section 80 for use with the molding section 70 shown in FIG. 8. As in the previous embodiment the decorative faces 20 intersect at a point 82 and are connected along the entire decorative face from top edge 21 to bottom edge 22. In addition a gap 84 is provided between the attachment flanges 12 and hinge portion 14, which gap also extends at least partway into horizontal structural member 72 and back member 26. The gap, which it will be understood is utilized at both inside and outside corners, allows for the assembly to be pushed into (or onto) a finished wall corner such that lower wall contact surface intersection 24 can be placed for best finished appearance, and the attachment flanges 12 can be securely attached wherever they land and can flex to an imperfect wall corner without disrupting placement of the intersection of the lower wall contact surfaces such that decorative face intersection and bottom edge intersection result in the appearance of a perfectly constructed crown molding intersection regardless of imperfection in the walk and wall corner to which the molding is attached. As with the previous embodiment, it may be advantageous to extend the gap 84 down so low that lower contact surfaces 24 do not actually meet each other. This can be advantageous to allow for known artifacts of drywall finishing at a corner, such as a corner bead which is often sticking out a small amount. As long as the bottom edges 22 of the molding meet, the decorative face intersection will appear uninterrupted to the room since the part of the molding assembly behind the intersection of the bottom edges is obscured by shadow (by design) and not necessary for a finished appearance. To connect a straight section 70 to corner section 80, an insert (not shown) is utilized as described above in slots 76 and 77 to align the decorative faces of the side by side pieces. In addition, an insert similar to inserts 48 and 49 discussed above with respect to the previously described embodiment may be inserted in internal cavity 78 in the molding body sections 20 situated below horizontal structural member 72. A piercing type fastener may then be passed through structural member 72 and the insert to secure the molding sections together. It will also be understood that while the embodiments of the invention are being described as including premade corners, both inside and outside corners, for rooms containing 90 degree corners, different corner angles such as 45 degree and 30 degree angles, any other useful corner angle, may be utilized.

It will be evident therefore that the molding section 70 can be interconnected using a process similar to the interconnection of the previously described embodiment, wherein the focus is on aligning the decorative face of each section using alignment pieces that are not visible to the room. In the embodiment shown in FIGS. 1-3, as described above a single internal sleeve style piece is sufficient for aligning interconnecting pieces. However, in the present embodiment, since internal cavity 78 does not travel the entire height of decorative face 20 from upper edge 21 to lower edge 22, additional pieces and securing methods are necessary. A piece of a finite length, such as two inches, would be sufficient to align two internal cavities 78, assuming a sleeve or insert shaped to fit the interior contours of internal cavity 78 is utilized. This sleeve could be fixed in place by a screw through both structural member 72 and the alignment sleeve, where one screw through both for each molding section being joined would lock not just the alignment sleeve in place, but would lock the two molding sections next to each other. Further uses of this embodiment may call for electric wires or other equipment to be installed within internal cavity 78. In this case, penetrating screws may disrupt the wires, puncturing insulation and causing an unsafe condition. Therefore, an adhesive may be used to secure the internal alignment sleeve such that it straddles the intersection of both molding sections where they meet. Also, once the adhesive sets, the alignment sleeve will also serve to maintain the two molding sections both aligned and closely next to each other. In the case where the continuous internal cavity 78 between multiple molding sections must be waterproof to function as a water-tight passageway, either the adhesive itself, or a sealing adhesive may be used and applied completely around the internal alignment sleeve such that a watertight seal is achieved.

One method for installing the alignment sleeve in the presently described embodiment calls for one or more holes to be drilled through structural member 72 in both molding sections which are to be abutted. These holes should be within about one-half the length of the alignment insert away from the ends of the molding sections which are to be abutted, and should be wide enough that the alignment insert could be moved within internal cavity 78 in the direction of the molding by tapping a flat screwdriver or similar tool through the holes drilled in structural member 72. After installing one of the molding sections to be abutted, the alignment sleeve is inserted completely inside internal cavity 78. If needed, sealant or adhesive can be applied to both internal cavities 78 such that when complete, the joint of the two abutting molding sections with an internal alignment sleeve spanning the joint is water tight. When the alignment insert is fully within internal cavity 78, the second molding section is placed. Then the alignment insert can be advanced within internal cavity 78 of the installed molding section towards the abutting molding section and advanced inside the second molding section. As long as this process is completed before the drying, setting or curing time of the adhesive or sealant is past, the result should be a physically aligned internal cavity, where the presences of the internal alignment sleeve is visible on both sides of the joint (through the holes that were drilled) and is watertight.

In addition to an alignment sleeve, other pieces are needed to ensure and secure alignment of decorative face 20 from top to bottom along a system of multiple sections of molding of this embodiment. As indicated above, therefore two notches 76 and 77 are provided for the insertion of an alignment tab. The purpose of the alignment tab is to ensure alignment of the middle of the decorative face 20 is maintained when two adjacent molding sections abut. An alignment tab may be a simple piece of plastic or other suitable material whose length is on the order of about two inches (or whatever length is necessary to secure alignment of decorative face 20) and wide enough to fit against the back of decorative face 20 between notches 76 and 77. The alignment tab must also have a thickness that allows for the tab to function as needed, and fit into the alignment notches 76 and 77. The method for using the alignment tab involves mounting the first molding section on the wall. The alignment tab can then be inserted into the mounted molding until at least all of the alignment tab has slid into notches 76 and 77 along the length of the molding far enough that no part of the alignment tab extends beyond the end of the molding section. The second molding section can then be placed in position immediately next to the mounted piece (the goal to provide the appearance of a continuance decorative face 20 when there are really two molding sections abutting). The alignment tab can then be slid towards the second molding section until about half of the length of the alignment tab is in each molding section. This can be accomplished by pushing the alignment tab into the notches of the new molding section, or can be tapped using appropriate tools, such as a hammer and a flat screwdriver or punch. The second molding section can now be permanently attached to the wall. In other embodiments, an alignment pin can be used to align the uppermost portions of decorative face when two molding sections are aligned, in which case slots for receiving the pins may be provided on the rear surface of the decorative face. The pins would have a length sufficient to align the uppermost portion of decorative face when spanning the abutting joint of two molding sections. Similar to the alignment tab, the pin can be placed fully inside the slot or placement location for the first mounted molding section, and then tapped into position spanning the joint and inside both slots or placement locations and securing a continuous appearing decorative face around the joint. A combination of alignment methods including those described above may also be utilized.

To reiterate, the core concept of the present invention is maintaining a preferentially straight decorative face even as the attachment flange is securely attached to an imperfect wall, which concept is extended to a premade corner. The intersection of decorative faces remain preferentially oriented and placed with the lower molding edge appearing perfectly defined (due to use of shadow) and the decorative faces from top to bottom edges, and from the start of the premade corner (where it would abut a separate molding section), on each side, would proceed in a preferentially straight manner to the decorative face intersection. This preferential orientation, alignment and intersection of the decorative faces occurs into what appears as a perfectly formed crown molding joint, even as the corner to which the premade corner is mounted is imperfect, and both attachment flanges, each drawn tightly to the imperfect corner, flex as needed. In addition, a gap as described above is present for either an inside or outside corner which would at the least allow for the attachment flanges to flex independently of each other when securely attached to the imperfect corner of the wall. The attachment flanges would extend into the corner far enough that a fastener driven through the attachment flange would be ensured to penetrate a framing member in all (or very nearly all) cases. In most construction this would mean extending the attachment flanges deep enough into the corner that a penetrating fastener would hit a stud. The two flanges would never meet at the corner, the resulting gap enabling independent flex.

In another embodiment, at the top of the molding, a location for lighting may be provided, while in another embodiment there is a structure designed to perform as a standard ⅞×⅞ inch metal suspended ceiling perimeter would. This embodiment would need to draw considerable strength from its material, and would likely benefit from an FRP or other composite. This embodiment would contain no lighting location, and in most typical installations would have a suspended ceiling and grid system installed to the structure and throughout the room. By creating a suspended ceiling perimeter structure, and designing into the FRP the necessary properties and strength within a shape and thickness that allows the structure to be installed with standard ceiling hardware that is designed to be used with a standard metal perimeter, ceiling installers can use all of the same materials, clips, grid members and installation methods for attaching a suspended ceiling to a standard metal perimeter to install a suspended ceiling to the structure, resulting in a finished crown molding appearance while using all existing ceiling hardware. An additional advantage would be the ability to use existing seismic clips and hardware, which, if new seismic clips and hardware were required, would need to undergo extensive and expensive testing to be certified. Similar to the above embodiment, the concepts applied to the straight section of this embodiment could be applied to premade corners, inside and outside, of any useful angle.

FIGS. 10-13 illustrate another embodiment of the crown molding assembly of the present invention. In FIG. 10-12 a straight crown molding section 90 is shown, which differs from the embodiment shown in FIG. 8 in that the horizontal cross member 72 of the molding portion in FIG. 8 has been modified and does not extend from the decorative face 20 of the molding continuously to the rear member 26 of the molding portion. Instead, as shown in FIG. 10, the horizontal cross member is interrupted in profile creating a gap 95 between inner horizontal member 92 and outer horizontal member 94 which, in cross section, extends for the entire length of the molding section. Such a gap 95 may be useful to provide access from above to the lower compartment situated below members 92-94, such as for insertion of electrical wiring in the compartment or other useful purposes.

Since the horizontal cross member is no longer continuous from the decorative face 20 to the rear 26 of the molding portion 16 of the molding system, the cross member no longer provides structural support for maintaining the preferred position of the decorative face 20 of the molding relative to the attachment portion 12 and the wall. FIGS. 10-12 also illustrate that, in the case that structural reinforcement similar to what would be provided by a continuous horizontal cross member is required, this can be added periodically as needed to maintain the desired position of the decorative face of the molding system under normal use by the provision of removable cross member 100. The cross member 100 is supplemental and acts as reinforcement. It is possible to design the molding as illustrated in FIGS. 10-12 with a very strong material, or designed with a materially thicker material, that would structurally maintain the position of the decorative face 20 of the molding system without additional reinforcement, especially in the case where the molding system is not used to support additional equipment or a non-structural ceiling, and is placed high enough in the room that it is out of reach of occupants of the room and, as such, would not be handled. However, it may also be desired to design the structure of the molding portion of the molding system such that the desired strength is achieved with the additional, secondary structure 100 shown.

The present invention does not depend upon the nature of the molding portion structure, whether it be a unitary structure that is consistent across its profile, or whether one or more structures are added as reinforcement to the molding portion of the system, so long as the decorative face is maintained in its desired position and the installation portion is still able to flex independently to absorb wall imperfections. Any additional reinforcing structure is located behind the decorative face, and any attachment methods or fasteners for securing one or more secondary reinforcing members will not disturb the decorative face.

Referring still to FIGS. 10-12, note that the rear portion of the molding portion 16 immediately above the interrupted inner cross member 92 has an angled portion 96 that angles away from the rear of the molding portion 16 before proceeding with leg 94 to the top of the rear portion of the interrupted cross member 92 vertically. This angled portion is placed so that an installer can drive a fastener 106 through this angled surface 96 after the molding system is installed on a wall, provided there is either a removable ceiling (such as a suspended ceiling) or sufficient space above the molding and below a rigid permanent ceiling. Additional reinforcing structural member 100 has a finger section 102 which is secured into the lower alignment insert slot 76 on the rear surface of the decorative face, which finger section 102 fits so that it grabs and holds the decorative face 20 in place from within slot 76. The rear portion 104 of the additional reinforcing structural member 100 includes an angled portion 106 which rests on top of the interrupted horizontal member 92 and also rests on the angled surface 96 that meets the rear of the molding portion, while the front portion 107 rests on outer cross member 98. This arrangement allows the additional reinforcing structural member 100 to be secured using a single fastener passed through the additional reinforcing structural member 100 and through the angled portion 96 of the molding system. As pictured in FIGS. 10 and 11, the fastener 109, such as a screw, need only be long enough to penetrate both the horizontal structural member 100 and the angled portion 96 of the rear of the molding portion, and can thereby secure the additional reinforcing structural member 100 without extending past the rear of the molding system or contacting the wall.

However, there may be conditions under which it may be desired to reinforce the desired placement of the lower contact portion 24 of the molding portion 16 against the wall, even though the simple pendulum action will continually urge that placement. For example, the invention enables a hinge like flex that allows the lower contact surface 24 to fall like a pendulum and contact the wall regardless of wall imperfections at the attachment portion 12 that would otherwise force the lower edge of a rigid molding system out from the wall. If the room is stable, and the molding system is not disturbed after it is installed, the hinge like flex serves well. However, if an earthquake were to substantially shake the walls to which the molding system is installed, that hinge-like flex may enable the molding system to sway and shake possibly cause damage as the room moves. To prevent such movement, and to ensure that the desired position of the lower portion of the molding system contacts the wall as desired, an additional fastener such as a screw 109 may be driven through the angled surface 96 within the molding portion 16 as shown in FIG. 12, and driven into the wall. The fastener 109 must be located below the pivot, and can serve as a supplemental reinforcement of the placement of the lower edge 24 of the molding system against the wall, and to prevent the movement of the molding system in an earthquake.

Figure 13:
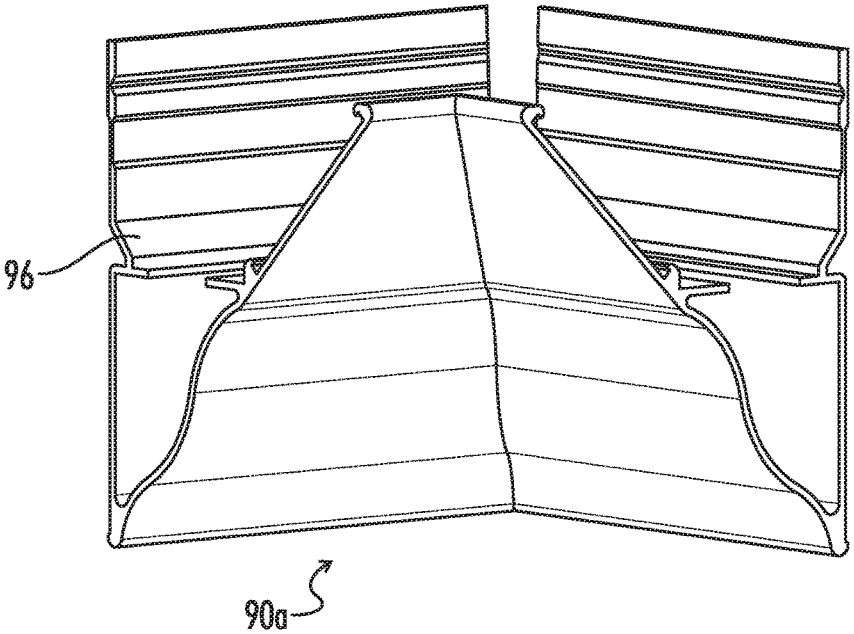
FIG. 13 is a perspective front view of an inside corner section for use with the crown molding section shown in FIGS. 10-12.

FIG. 13 illustrates an inner corner section 90*a* for use with the molding section 90. It will be understood that the inner corner section 90*a* may be connected abutting sections in a manner similar to that described herein with respect to the earlier described embodiments. In particular, however, it is noted that the detachable reinforcement sections 100 should be secured to the molding sections at a location which is spaced apart from the ends of the individual molding sections so as not to interfere with the connecting together of abutting sections. Thus, the notch 96 serves a dual purpose of supporting an alignment tab between abutting sections as well as being periodically used to secure the supplemental cross members 100 as needed.

Figure 14:
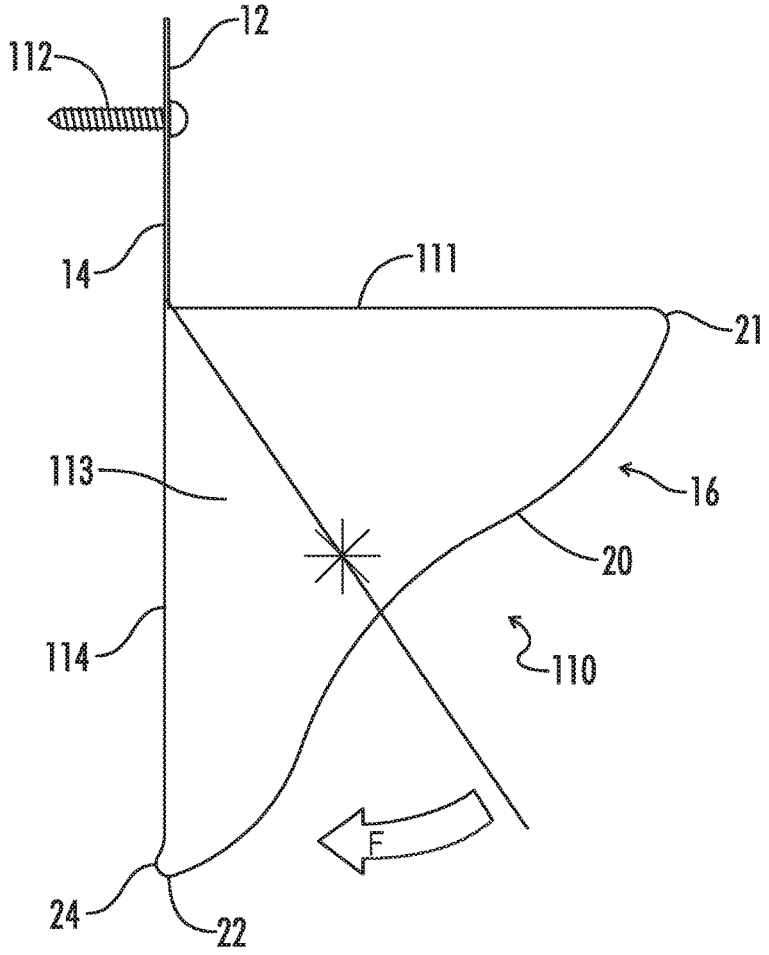
FIG. 14 is side diagrammatic view of another embodiment of the crown molding assembly of the present invention.
Figure 15:
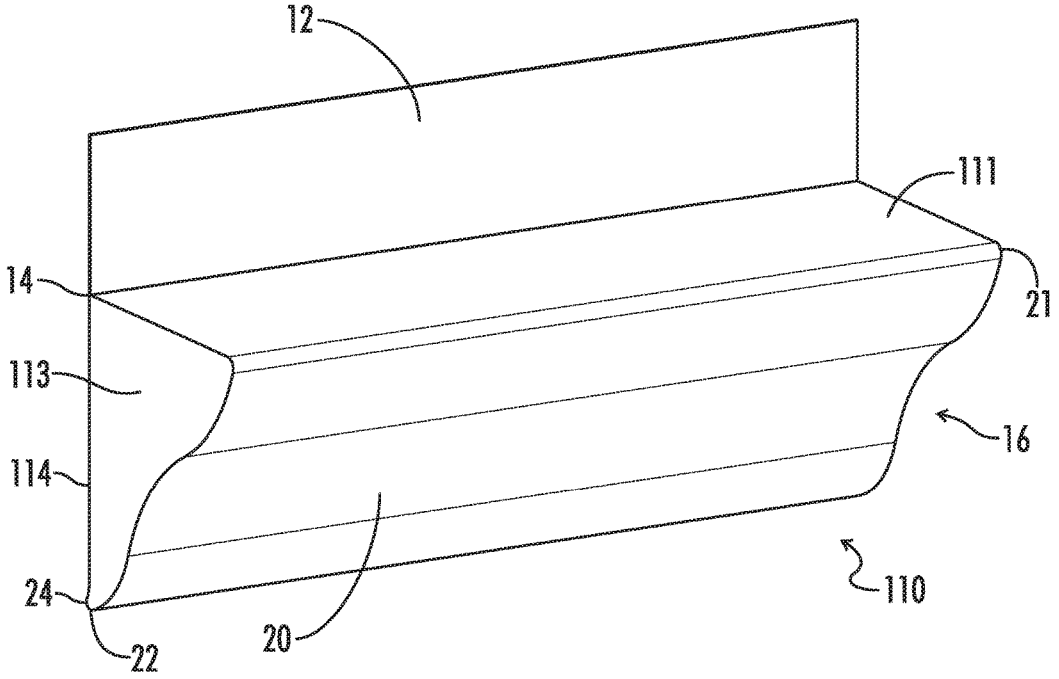
FIG. 15 is a perspective view of the molding section shown in FIG. 14.

FIGS. 14-15 illustrate another embodiment of the present invention, in which the crown molding section 110 has a solid molding section 16. Molding section 110 also has an attachment portion 12 which is made from a flexible material such as cloth. In this embodiment, the cloth is sufficiently strong, particularly against shearing and tearing, that a fastener such as screw 112 in FIG. 14 can be driven through attachment portion 12 and into the wall and can be securely tightened and thus support molding section 110. An example of such a cloth material of sufficient strength is that used for seatbelts, which has great strength and great flexibility. In this embodiment, the cloth material of attachment portion 12 extends inside of the solid interior portion 113, where it has been bonded, using existing technologies, into the solid material comprising molding portion 16. Such bonding can occur during an extrusion or molding process using existing practices. This co-extrusion or co-molding results in a unitary molding section 110.

Given the inherent flexibility of the cloth material comprising attachment portion 12, no specific design of the attachment portion is needed to enable hinge 14. The inherent flexibility of the cloth material will enable the pivot to molding portion 16's pendulum and enable force F of FIG. 14 to ensure placement of lower contact surface 24 against the wall. The inherent flexibility of the cloth material of attachment portion 12 also permits secure attachment to wall irregularities without transmitting those irregularities to molding portion 16.

Rear surface 114 of the molding portion 12, similar to other embodiments, curves in and away from the wall above lower contact surface 24 in order to clear any wall imperfections that protrude from the wall. Due to the solid structure of molding portion 16, upper surface 111 and decorative face 20, from lower end 22 to upper end 21, will each remain preferentially straight independent of any flex absorbed by attachment portion 12. With an upper surface that remains preferentially straight, molding section 110 would be well suited to acting as the perimeter of a suspended ceiling, supporting both ceiling frame members and tiles. It will be understood that materials other than cloth but having a similar flexibility and strength characteristics may be alternatively utilized as in the presently described embodiment.

In certain embodiments of the present invention, the crown molding the decorative face is thicker than the other components of the molding system, such as the vertical surface that meets the wall, the horizontal section that starts at the top of the decorative face, and the attachment flange. In such embodiments, when a fastener secures the attachment flange securely to a wall, or alternately an adhesive of sufficient strength may be used in place of a piercing fastener, the flange distorts to any irregularities, and those irregularities may or may not reflect or transmit to the vertical surface below the attachment area and the horizontal surface, but because of the additional material behind the decorative face, the decorative face will be less able to flex and, therefore, remain preferentially straight to the intended wall design.

In addition, as mentioned above, certain embodiments of the crown molding assembly of the present invention make use of a curve at the bottom of the molding assembly. The decorative face curves down towards the absolute bottom edge of the molding and curves through the bottom edge around to point wall contacting point as described above. For current purposes the curve is described as a circle whose radius pointing down and completely vertical is point the bottom edge, and the radius points into the wall horizontally forms the lower wall contact surface, while the radius pointing away from the wall and horizontal is near the bottom of the decorative face. An alternative description is that, in cross section, the bottom of the molding assembly is defined by a semicircle. That semicircle is the bottom half of a circle, and the bottom edge and lower contact points and the other end of the semicircle blends in smoothly into the rest of the decorative face travelling up to the top edge.

As discussed herein, the hinge or flex point between the attachment flange and decorative molding portions of the crown molding assembly is designed to facilitate two major features of the described implementation of the improved crown molding system. First, the flex point allows for the attachment flange to be drawn tightly to an irregular wall, and in addition to flex to meet those irregularities and provide a secure attachment for one or more fasteners through the attachment flange and into the wall onto which the crown molding system is attached, presumably into a stud or other framing member to facilitate secure attachment. The flex point prevents those irregularities from transmitting from the attachment flange to any other components of the molding assembly below the flex point. As such, the flex point may flex in any direction necessary to facilitate the flex needed as a result of secure attachment of the attachment flange to an irregular wall.

Second, the flex point acts as a pivot point for the improved molding assembly to pivot into the wall, most importantly, at lower wall contact surface. This comprises an improvement over the inventors' crown molding assembly described in U.S. Pat. No. 8,887,460. The earlier molding assembly pivots as a whole, and uses a single attachment point (in profile) as the pivot, with the entire molding assembly acting as a simple pendulum urging the molding assembly into the wall to which it is attached. This present invention, however, builds a pivot point into the molding assembly, below and separate from where the molding system is attached. As a result of separation of the attachment point and pivot point, the present molding assembly can be securely attached by any method that is useful, including adhesive, or multiple attachments in profile (including multiple screws, one directly above the other), and because the flexpoint provides the pivot, the molding will still behave as a simple pendulum with the lower molding contact surface being urged into the wall to which the molding system is attached.

As a result of these two actions of the flex point; one, allowing the attachment point to flex as it is drawn tightly to an irregular wall, while maintaining a preferentially undisturbed molding assembly and decorative face below; and two, the flex point acts as a pivot facilitating the pendulum action of the lower contact surface into the wall to which it is attached. Any additional hardware attached to the molding system below the flex point, such as suspended ceiling components, will reinforce the pendulum action and will reinforce the desired location of lower contact surface at the wall. The flex action can be created by using thinner material at the hinge or flex point, or using a different material, or a different curing process that imparts greater flexibility to the material forming the hinge or flex point, or other methods in the art to enable the described flex.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. As used throughout, ranges are used as shorthand for describing each and every value that is within the range. Any value within the range can be selected as the terminus of the range.

What is claimed is:

1. A molding section comprising:

a flexible vertical wall attachment portion extending along a longitudinal axis of the molding section wherein the flexible vertical wall attachment portion has a first thickness, a flexible hinge portion also extending along said longitudinal axis, said hinge portion having an upper end and a lower end and including a flex point, and being connected to an end of or forming part of the flexible vertical wall attachment portion, wherein the flexible hinge portion has a second thickness such that the second thickness is less than the first thickness, and a molding portion including a decorative face having an upper edge and a lower edge, a rear surface, and a lower wall contacting surface, said molding portion connected to the lower end of the hinge portion at a location above the center of mass of the molding portion when the molding section is secured to a vertical wall surface, whereby the lower wall contacting surface is continually urged into contact with said vertical wall surface.

2. The molding section of claim 1 in which the attachment portion is able to flex in each of the x, y, and z axes in order to compensate for short distance irregularities of a wall surface.

3. The molding section of claim 2 in which the molding portion additionally comprises a rear member connected to the lower wall contacting surface, said rear member extending upwardly from and being spaced inwardly from the lower wall contacting surface.

4. The molding section of claim 3 in which the molding portion additionally comprises a cross member extending between the decorative face and said rear member.

5. The molding section of claim 2 in which the attachment portion is comprised of a cloth material.

6. The molding section of claim 4 in which the cross member is interrupted and additionally comprising a detachable cross section reinforcement which is securable to the cross member across a gap formed by said interruption.

7. The molding section of claim 1 in which the attachment portion is flexible in all directions in order to meet expected variations a non-planar surface.

8. The molding section of claim 1 in which the center of mass of the molding portion is located below the flex point of the hinge portion.

9. The molding section of claim 2 in which the molding section is integrally formed as a single unit.

10. The molding section of claim 9 in which the molding section is formed by a pultrusion process in which at least the attachment portion and hinge have a fiber-reinforced polymer structure.

11. The molding section of claim 10 in which the molding portion has a structure such that the decorative face is maintained straight independent of the straightness of the flexible attachment portion when the molding section is secured to a wall surface supported by the attachment portion.

12. The molding section of claim 11 additionally comprising an alignment insert member for joining adjacent molding sections together in an abutting relationship with the decorative faces of said molding portions in alignment.

13. The molding section of claim 1 additionally comprising an assembly for joining two molding sections at other than a 180 degree angle.

14. The molding section of claim 13 in which said assembly includes two short molding connection sections positioned at other than a 180 degree angle with respect to each other, said short molding sections having their decorative faces joined and intersecting between their upper and lower edges, and with a gap extending between the attachment portions of the short molding sections to enable the assembly to be adjustably positioned on a wall surface, and a pair of alignment inserts for aligning the molding connection sections with one of said molding sections.

15. The molding section of claim 14 additionally comprising a corner assembly for joining two molding sections at an inside wall corner.

16. The molding section of claim 14 additionally comprising a corner assembly for joining two molding sections at an outside wall corner.

17. The molding section of claim 14 in which said gap extends through the lower contact surfaces of the short molding connection sections.

18. A molding section comprising:

a decorative molding portion including a decorative face having an upper end and a lower end, a lower wall contacting surface connecting with said lower end, a back member connected to and extending upwardly from the lower wall contacting surface, said back member offset inwardly on the molding section from the lower wall contacting surface, and an upper member connecting between the decorative face and the back member, an attachment portion having a first thickness, a wall contacting surface and an opposite surface, said attachment portion configured to be secured to a wall surface and to flex as needed for the wall contacting surface to be in contact with said wall surface along the entirety of said attachment portion, and a hinge extending along an edge of the attachment portion and connecting between the attachment portion and back member of the decorative molding portion, wherein the hinge has a second thickness such that the second thickness is less than the first thickness, the molding portion configured so that when the attachment portion is secured to a wall surface the lower wall contacting surface will be continually urged into contact with the wall surface as a result of a rotational force of the molding portion about a flex point of said hinge.

19. The molding section of claim 4 in which the rear member extends between the lower wall contacting surface and at least the cross member.

* * * * *